United States Patent [19]

Calcaterra et al.

[11] Patent Number: 4,864,687

[45] Date of Patent: Sep. 12, 1989

[54] THREE PIECE LIFT-OFF DOOR HINGE

[75] Inventors: Ronald C. Calcaterra, Utica; Edward R. Ginther, Rochester; Cornelius T. Heiler, Detroit, all of Mich.

[73] Assignee: Chrysler Motors Corporation, Highland Park, Mich.

[21] Appl. No.: 297,518

[22] Filed: Jan. 17, 1989

[51] Int. Cl.[4] ..... E05D 7/04

[52] U.S. Cl. ..... 16/237; 16/264; 16/266; 16/270; 16/296; 16/308; 16/332; 16/334; 16/382; 16/389

[58] Field of Search ..... 16/261–266, 16/270, 271, 272, 237, 296, 297, 308, 332, 334, 335, 344, 382, 389

[56] References Cited

U.S. PATENT DOCUMENTS

| | | | |
|---|---|---|---|
| 4,532,675 | 8/1985 | Salazar | 16/335 |
| 4,720,895 | 1/1988 | Peebles | 16/264 |
| 4,765,025 | 8/1988 | Salazar | 16/261 |
| 4,807,331 | 2/1989 | Calucci | 16/262 |

*Primary Examiner*—Richard K. Seidel
*Assistant Examiner*—Edward A. Brown
*Attorney, Agent, or Firm*—Edward P. Barthel

[57] ABSTRACT

A door hinge assembly enabling a vehicle door to be readily removed and rehung during an assembly line operation. Upper and lower hinge door-half sub-assemblies each include a generally hat-shaped door mounting plate secured to the vehicle door and a U-shaped link plate connected to an associated door mounting plate by a pintle pin. Each link plate has a threaded bore in its base wall and a dowel extending downwardly from an upper flange. Upper and lower L-shaped body mounting plates, each having a first leg secured to the body, include an upper web with a dowel hole adapted to receive its associated link plate dowel. Each door mounting plate second leg has a threaded bore while a removable key locks each pair of sub-assembly plates fixing the door in a predetermined hold-open removal mode. To hang the door each link plate depending dowel is inserted in its associated body plate dowel hole aligning their respective threaded bores. Tightening a bolt in the aligned bores interlocks each upper and lower set of base and link plates whereby upon removal of the keys each bolted pair of link and body plates pivotally support the door on their associated upper and lower body plates.

4 Claims, 8 Drawing Sheets

THREE PIECE LIFT-OFF DOOR HINGE

BACKGROUND OF THE INVENTION

This invention relates generally to automobile door hinges and, more particularly, to a three piece lift-off door hinge mounting arrangement allowing a door to be readily removed in a lift-off manner from a vehicle body during an assembly line operation, for example.

The U.S. Pat. No. 4,720,895 issued Jan. 26, 1988 to R. H. Peebles discloses a quick-disconnect three piece vehicle door hinge that enables the doors to be quickly removed and rehung during the assembly line advancement of the vehicle body. This allows the interior of the removed doors to be readily equipped and trimmed while supported on a suitable assembly fixture.

The U.S. Pat. No. 4,765,025 issued Aug. 23, 1988 to Salazar discloses a vehicle door mounting arrangement for effecting vertical removal of the door. The Salazar system includes an improved lift-off door hinge together with a conventional door hinge having an integral check disclosed in U.S. Pat. No. 4,532,675 issued Aug. 6, 1985 to Salazar. The Salazar '675 patented hinge is adapted to cooperate with the modified lift-off door hinge of the Salazar '025 patent permitting assembly and removal of the door during movement of the vehicle body along a modern automotive assembly line.

SUMMARY OF THE INVENTION

It is an object of the present invention to provide an improved door hinge mounting arrangement enabling a vehicle door mounted hinge plate and pinned link plate sub-assembly to be readily separated from a vehicle body mounted hinge plate in a door lift-off manner and remounted on the vehicle body mounted hinge plate during assembly line advancement of the vehicle.

It is another object of the present invention to provide a vehicle door lift-off hinge arrangement as set forth above in which two vertically separated three piece hinge assemblies each include a door-half pinned sub-assembly comprising a door mounting plate fixed to a vehicle door and a link plate pinned by a pintle pin thereto, wherein each link plate may be temporarily locked in a ready manner to its associated door plate during the door removal and remounting operation.

To this end, according to the present invention, the door-half sub-assembly of the three member hinge assembly is formed by two members relatively swingable about a hinge pintle pin, i.e., a door mounting plate and a link plate. The hinge assembly third member is a door mounting plate adapted for bolting to a vehicle door panel. The door mounting plate is generally hat-shaped defining upper and lower horizontally oriented parallel arms interconnected by a vertically extending strap portion. The link plate is generally U-shaped having a vertically disposed base wall formed with a threaded through bore. The link plate has an upper flange and a lower flange lobe spaced for reception between the door mounting plate arms. Aligned holes in the upper flange and lower flange lobe are pivotally connected by the pintle pin to aligned holes in the door mounting plate upper and lower arms.

The body mounting plate is L-shaped in horizontal section comprising a body mounting first leg secured to a panel of the vehicle body and a link plate attaching second leg formed with a threaded bore. Upper and lower horizontal webs interconnect the mounting plate first and second lgs. The upper web has a dowel hole therein adapted to receive without play a mounting dowel projecting downwardly from the underside of the link plate upper flange.

The body hinge plate second leg has a threaded bore therethrough aligned with the link plate base wall threaded bore upon its exterior surface being placed in flush abutment with the link plate base wall interior surface and the mounting dowel being seated in the link plate dowel hole. With a bolt threadably engaging the aligned bores the link plate and body plate are positively interlocked to the vehicle body so as to pivotally support the door mounting plate. To remove the door it is swung to its full open position allowing a locking key to be inserted in aligned keyways in the door plate upper arm and the link plate upper flange. Removal of the single bolt frees the link plate from the body plate enabling the door to be raised vertically in a lift-off manner from the body mounting plate. The vehicle door is, of course, provided with upper and lower vertically spaced hinge assemblies each of which is removed by the above described procedure.

To rehang the door on the vehicle body the door is moved laterally until the link plate base wall interior surface of each upper and lower hinge assembly is in flush abutment with its associated body mounting hinge plate end wall. Upon the completion of the door lateral movement the door is lowered wherein each link member depending dowel is received in its associated body mounting plate aligned dowel hole. Upon the reception of a threaded bolt in the aligned threaded bores of both the upper and lower pair of link and body plates the door is remounted in its full open position.

An additional feature of the present invention involves stop means being provided between a portion of the door mounting plate and its associated link plate upon the door reaching its full open lift-off position. The stop means positions each pinned pair of door and link plates such that their respective door and link plate keyways are aligned allowing the ready insertion of their associated locking key therein. In the preferred embodiment the strap portion inner surface of each door plate contacts the opposed edge of its associated link plate upper flange thereby stopping the door in its predetermined full open lift-off position.

DESCRIPTION OF THE DRAWINGS

These and other features, objects and advantages of the invention will become apparent upon consideration of the specification and appended claims in which:

DESCRIPTION OF THE PREFERRED EMBODIMENT

Figure 1:
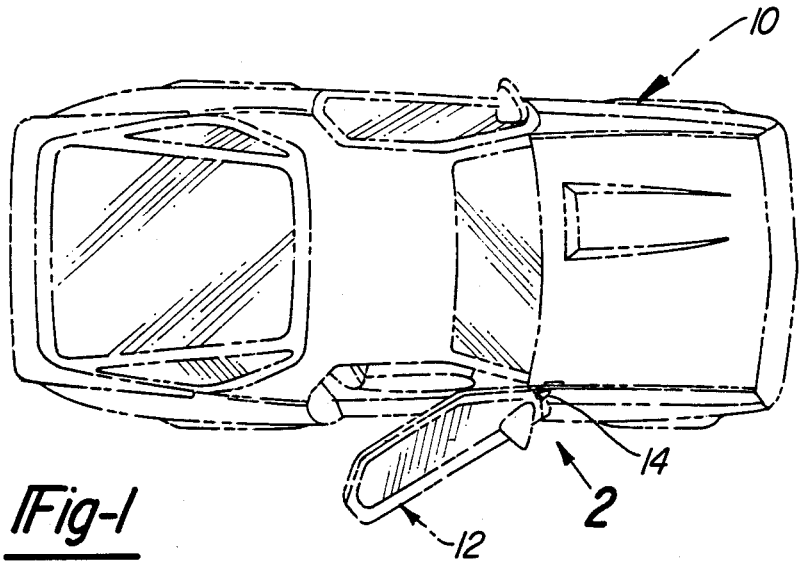
FIG. 1 is a top elevational view of an automotive vehicle showing the right hand door swung to a partially opened position by the door hinges of the present invention.
Figure 2:
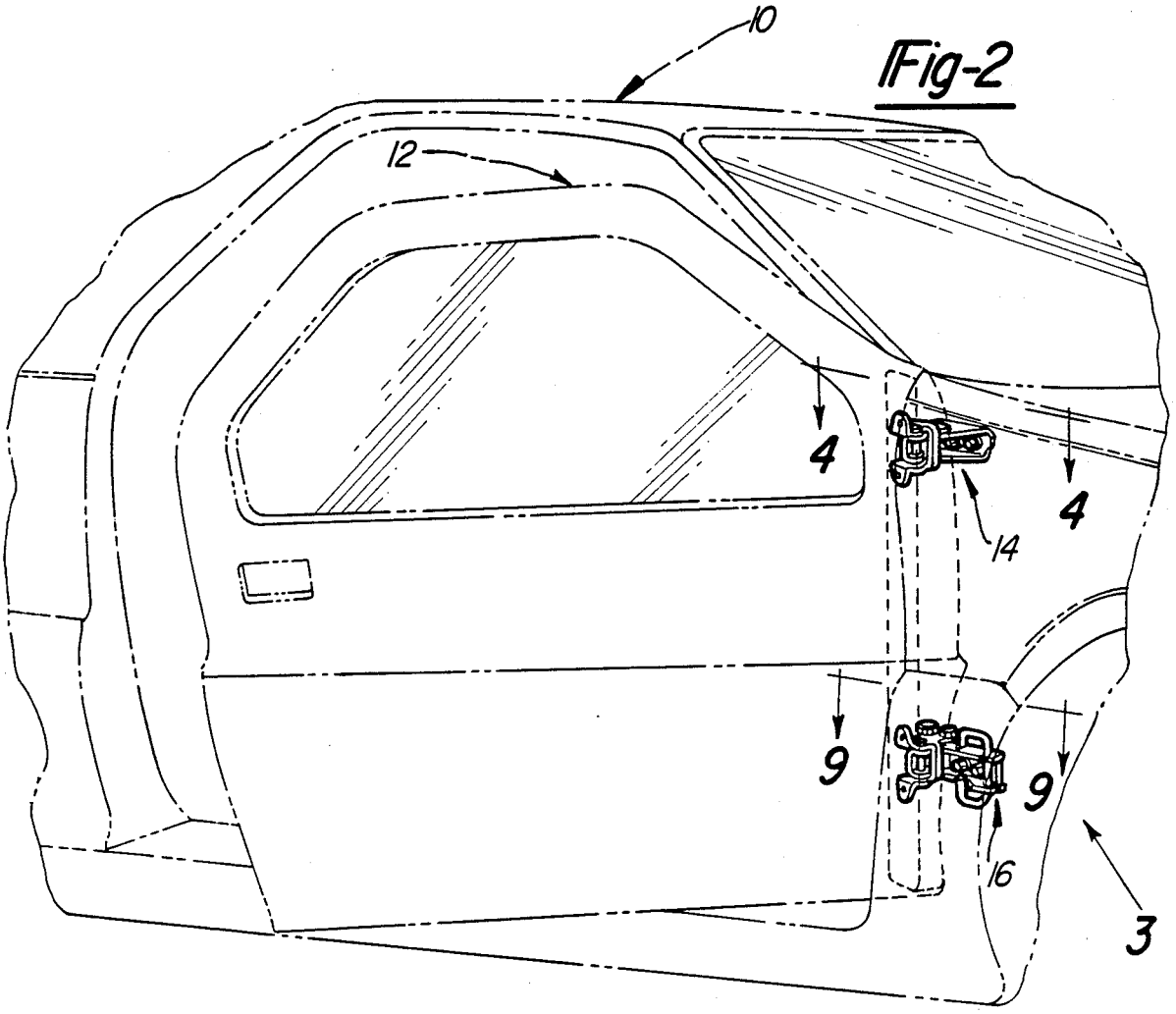
FIG. 2 is a fragmentary perspective view of the vehicle of FIG. 1 showing the right hand door upper and lower hinge assemblies oriented relative to the vehicle body.

Referring now to the drawings, FIG. 1 is a top view of a motor vehicle 10 showing right hand passenger side door 12 in a partially open position. FIG. 2 is an enlarged perspective view taken in the direction of arrow "2" shown in FIG. 1 wherein an upper hinge assembly 14 and a lower hinge assembly 16 are depicted supporting the right hand side door 12.

Figure 3:
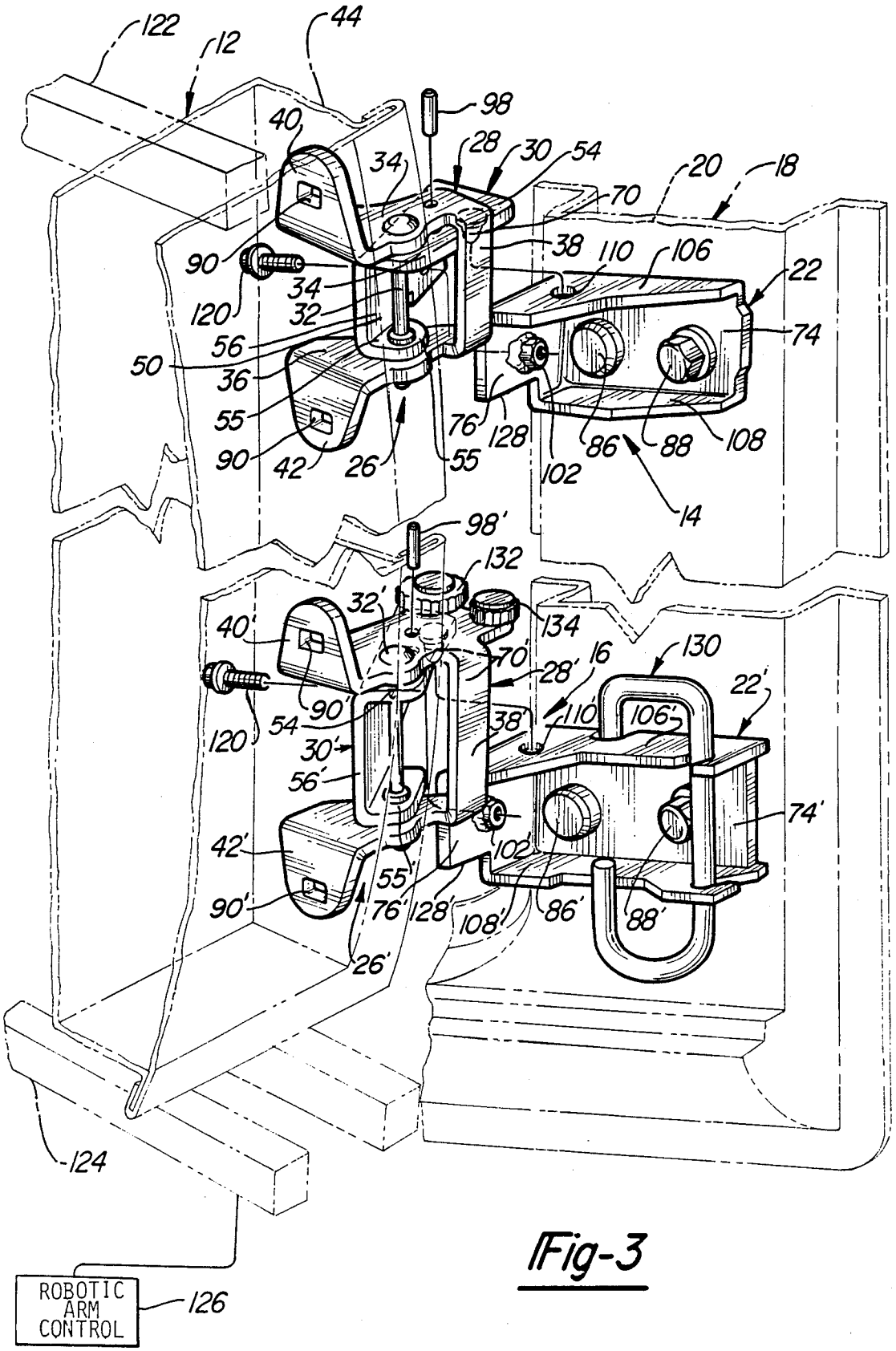
FIG. 3 is a fragmentary, perspective view of the vehicle body upper and lower hinge assemblies of FIG. 2 with the right hand door removed from the vehicle body in a lift-off manner in accordance with the present invention.
Figure 4:
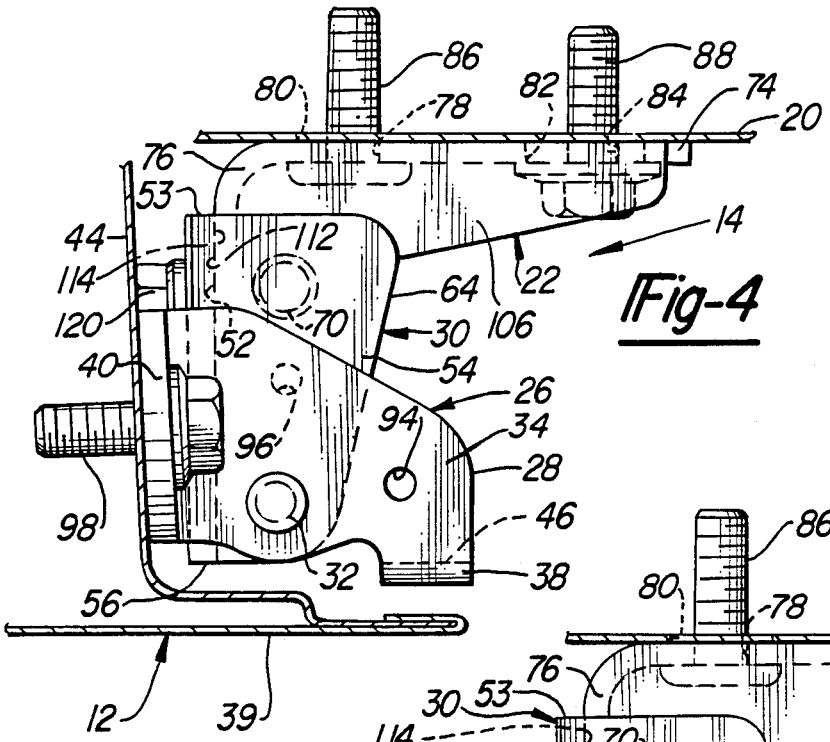
FIG. 4 is a fragmentary, top elevational view of the upper hinge assembly of FIG. 2 showing the door in its closed position.
Figure 5:
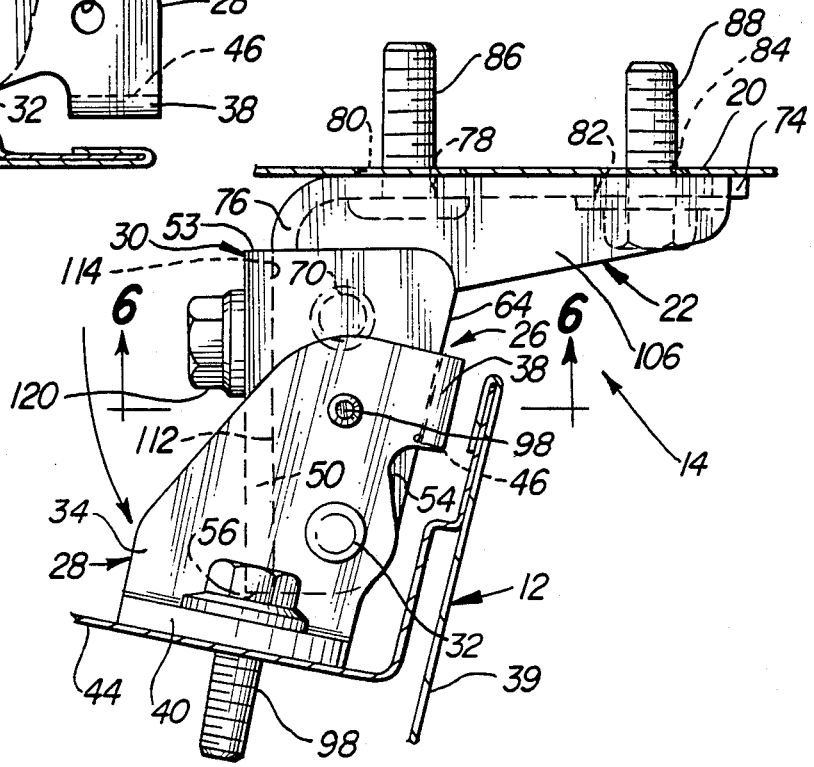
FIG. 5 is a view similar to FIG. 4 showing the door upper hinge assembly in its full open and locked lift-off mode.

FIG. 3 is an enlarged exploded perspective view of the upper and lower hinge assemblies of FIG. 2 wherein a portion of a vehicle body hinge post or pillar 18 is shown in phantom including a longitudinally extending mounting panel 20. The body panel 20 is adapted to removably support upper body mounting plate 22 of the upper hinge assembly 14 and lower body mounting plate 22' of the lower hinge assembly 16.

With reference to FIGS. 4–8, the upper lift-off hinge assembly 14 as illustrated includes an upper door-half sub-assembly 26 together with its upper body mounting plate 22. The upper hinge door-half sub-assembly 26 comprises a hat-shaped door mounting plate 28 and a link plate 30 pivotally connected together by a pintle pin 32 and locked in position by a snap ring 33. The door mounting plate 28 is formed with an upper arm 34 and lower arm 36 horizontally disposed in parallel relation with the arms joined adjacent their distal ends by a vertically extending connecting strap portion 38 oriented parallel to door side panel 39.

The proximate ends of each door mounting plate arm 34 and 36 are bent outwardly at a right angle forming upper and lower mounting ears 40 and 42, respectively, adapted for flush contact with door frame vertical panel 44. It will be noted in FIG. 7 that inner surface 46 of the strap portion 38 defines a stop surface operative to contact an angled edge of the link plate 30 defining the full-open travel of the door 12.

Figure 7:
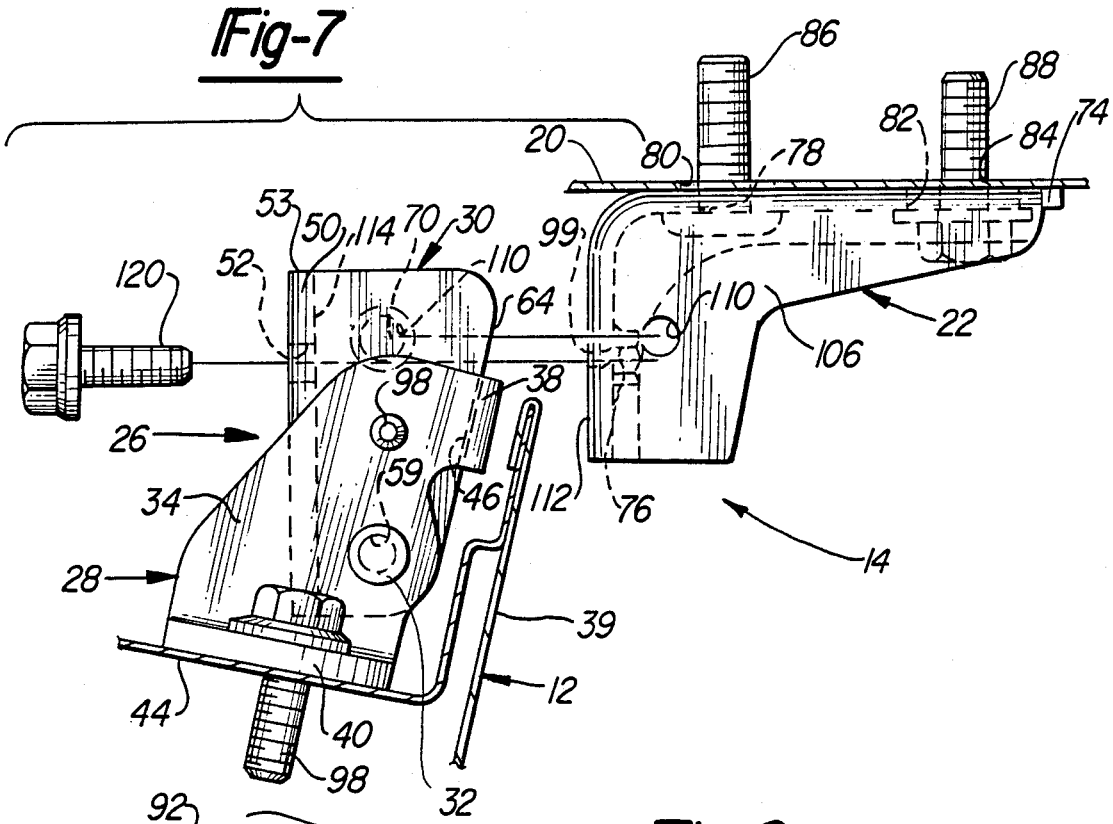
FIG. 7 is a view similar to FIG. 5 showing the door separated from the body in its lift-off mode.
Figure 8:
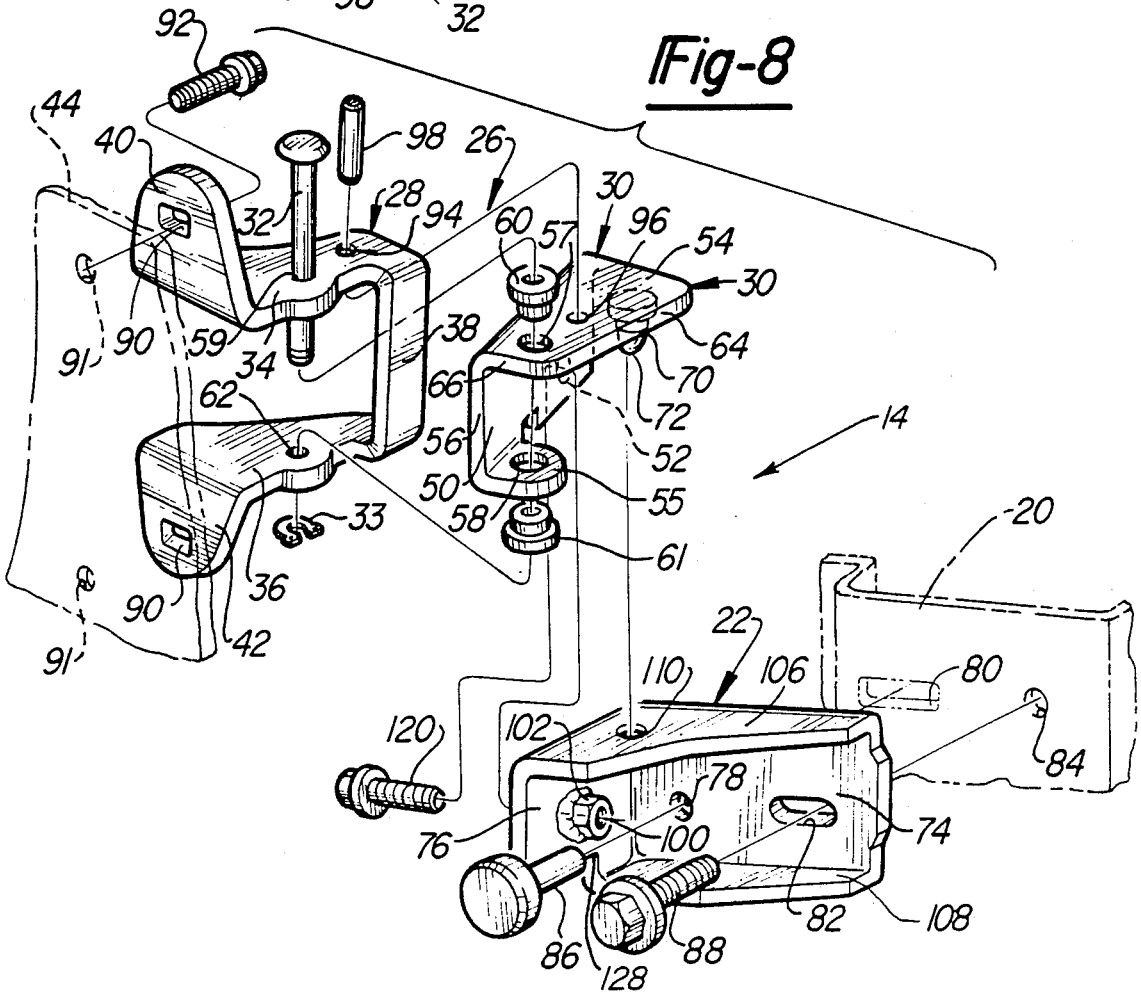
FIG. 8 is an exploded perspective view of the upper hinge assembly of FIG. 5.
Figure 9:
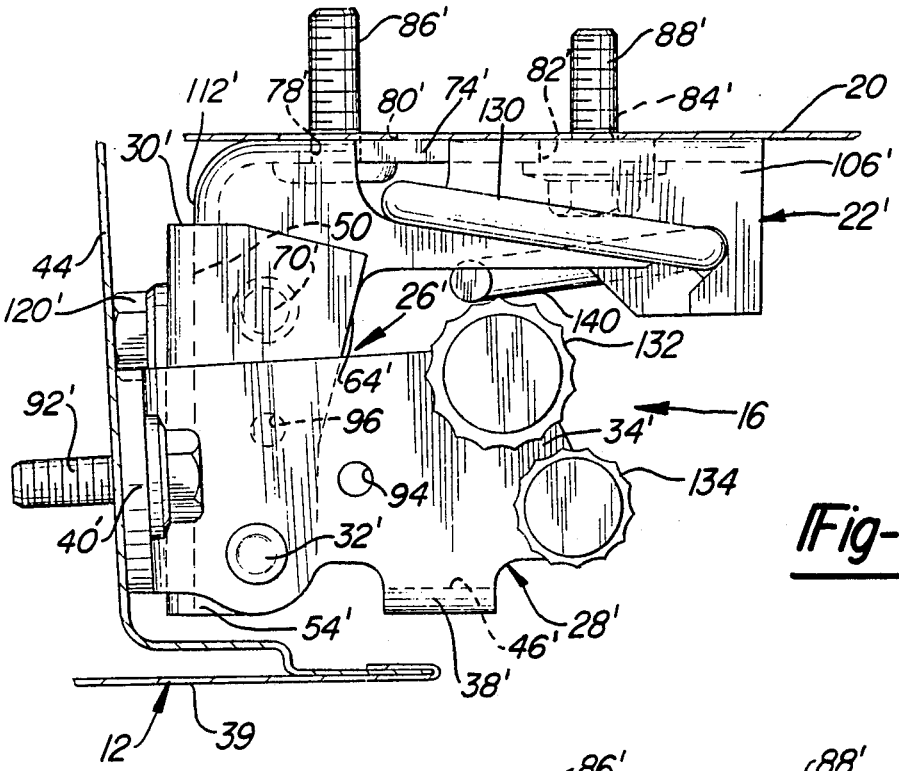
FIG. 9 is a fragmentary, top elevational view of the lower hinge assembly of FIG. 2 showing the door in its closed position.

As seen in FIGS. 7 and 8 the link plate 30 comprises a vertically disposed base wall 50 having a through-bore 52, adjacent one vertical side edge 53. The base wall 50 is formed integral with an upper horizontally disposed full flange 54 and lower partial flange 55 extending parallel to the full flange 54 and adjacent its other vertical edge 56 of the base wall 50. Aligned bores 57 and 58 are provided in the upper full flange 54 and the lower partial flange 55, respectively. Upon the pintle pin 32 being inserted in hole 59 of the door plate upper arm the pin 32 is journally received in aligned journal bearings 60 and 61, fitted in respective bores 57 and 58, prior to extending through holes 62 in the lower arm and locked by snap ring 33.

Figure 6:
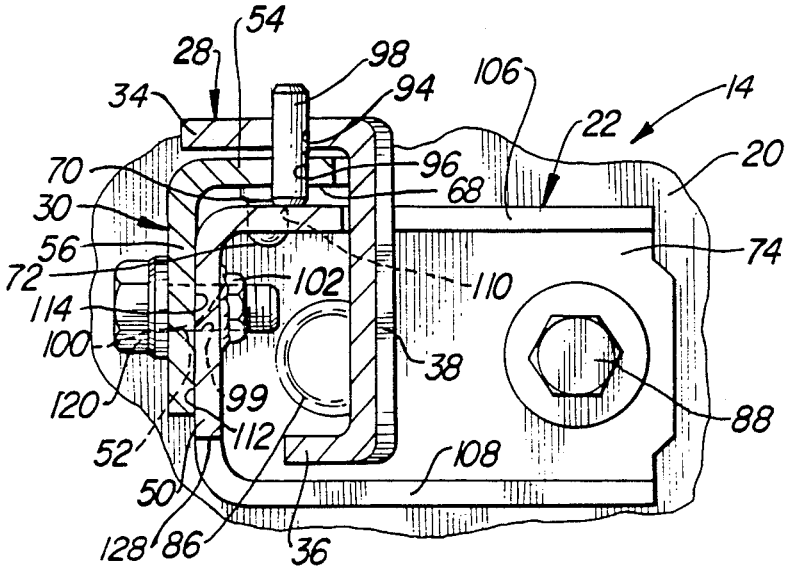
FIG. 6 is a vertical sectional view taken on the line 6—6 of FIG. 5.

It will be noted in FIGS. 7 and 8 that angled edge 64 of the link plate upper flange 54 slopes outwardly from its one transverse smaller side edge 66 such that the upper flange 54, as viewed in plan (FIG. 7), has a trapezoid shape. As seen in FIG. 6, the link plate upper flange undersurface 68 has a cylindrical coupling dowel 70 extending vertically downwardly therefrom with its lower end 72 rounded in a bullet-like manner. In FIGS. 7 and 8 it will be noted that the body mounting plate 22 is L-shaped in horizontal section providing a body mounting long leg 74 and a link attaching short leg portion 76. The long leg 74 has an attachment hole 78 for alignment with a first body panel mounting elongated slot 80. The long 74 leg also has an elongated slot-shaped aperture 82 adapted for alignment with a body panel second mounting hole 84. In the disclosed embodiment a threaded stud 86 is pre-assembled in the body mounting plate hole 78, as by welding, while the slotted aperture 82 and aligned hole 84 are adapted to receive a threaded bolt 88 by the assembly line installer. The upper door plate has its ears 40 and 42 fixed to the door frame panel 44 by means of their elongated slots 90 being aligned with associated door frame holes 91 for the reception of threaded bolts 92. It will be appreciated that the elongated slots 80 and 82 allow for lateral adjustment of the body plate 22 on the body panel 20.

With reference to FIGS. 6–8 it will be seen that the door mounting plate 28 has its upper arm 34 provided with a keyway 94 adapted to be aligned with a subjacent keyway 96 in the link plate upper full flange 54. Upon the door 12 being pivoted through a predetermined angle to its full-open stop position, shown in FIG. 5, the door mounting plate stop surface 46 contacts the link plate angled edge 64. In the preferred embodiment the door 12 is moved through an acute angle of about 76 degrees to its full-open FIG. 5 position whereby the keyways 94 and 96 are aligned to receive a locking key 98. Upon the insertion of the key 98 in its associated keyways 94 and 96 the door plate 28 and its link plate 30 are locked in their FIG. 7 position against relative rotation.

FIGS. 7 and 8 show the body mounting plate 22 short leg 76 having a through bore 99 aligned with internally threaded bore 100 of nut 102 welded to the inner surface of the short leg. The body mounting plate includes upper and lower horizontal webs 106 and 108, respectively. The upper web 106 is provided with a coupling dowel hole 110 sized for the snug reception of the link plate depending coupling dowel 70 without radial play upon the flush contact of short leg outer surface 112 with inner surface 114 of the link plate base wall 50. The location of the link plate coupling dowel 70 and the body plate coupling hole 110 are such that with the mutually opposed surfaces 112 and 114 in flush contact the principal axis of the coupling dowel 70 is readily aligned on the center of the coupling hole 110. Thus, the door 12 and attached link plate 30 are adapted to be guided vertically downwardly enabling the seating of the dowel 70 in the aligned coupling hole 110.

At the conclusion of the door and link plate vertical travel the body plate short leg hole 99 and nut threaded bore 100 are aligned with the link plate base wall hole 52. Upon engagement of a single machine threaded bolt 120 in threaded bore 100 tightening of the bolt draws together the mutually opposed surfaces 112 and 114 interlocking the body and link plates 22 and 30 in positive fixed engagement.

It is a feature of the present invention that the locked door-half sub-assembly 26, fixed to the door 12 by bolts 98, is designed in one application to be advanced laterally toward the body mounting plate 22 by automated door conveying means such as a robot, indicated schematically by robot arms 122 and 124 in FIG. 3. The movement of the robot, of course, would be electronically governed in a programmed manner by suitable control means indicated by box 126. Reference may be made to U.S. Pat. No. 4,685,208 to Sekiraku disclosing one form of automated apparatus suitable for use with the present the disclosure of which is incorporated by reference herein.

With reference to FIG. 3 it will be noted that the body mounting plate has a portion of its short leg 76 and a portion of its lower web 108 notched-out at 128 providing clearance for movement of the door mounting plate 28 when the door is swung open or closed.

Referring now to the FIGS. 9–13 the lower lift-off hinge assembly 16 includes a lower door-half sub-assembly 26' and a lower body mounting plate 22'. As the upper and lower door-half sub-assemblies and the upper and lower body mounting are substantially the same in design and operation like numerals will be used to indicate like or similar components with the lower hinge components being primed.

The lower door-half hinge sub-assembly 26' comprises a door mounting plate 28' and a link plate 30' pivotally connected together by a pintle pin 32' and locked in assembly by snap ring 33'. The lower door mounting plate 28' is formed with an upper arm 34' and a lower arm 36' horizontally disposed in parallel relation with the arms connected adjacent their distal ends by a vertically extending strap connecting portion 38' oriented parallel to the door side panel 39. The proximate end of each door mounting plate arm 34' and 36' is bent outwardly to form upper and lower right-angled mounting ears 40' and 42', respectively, adapted for flush contact with the door frame vertical panel 44.

Figure 12:
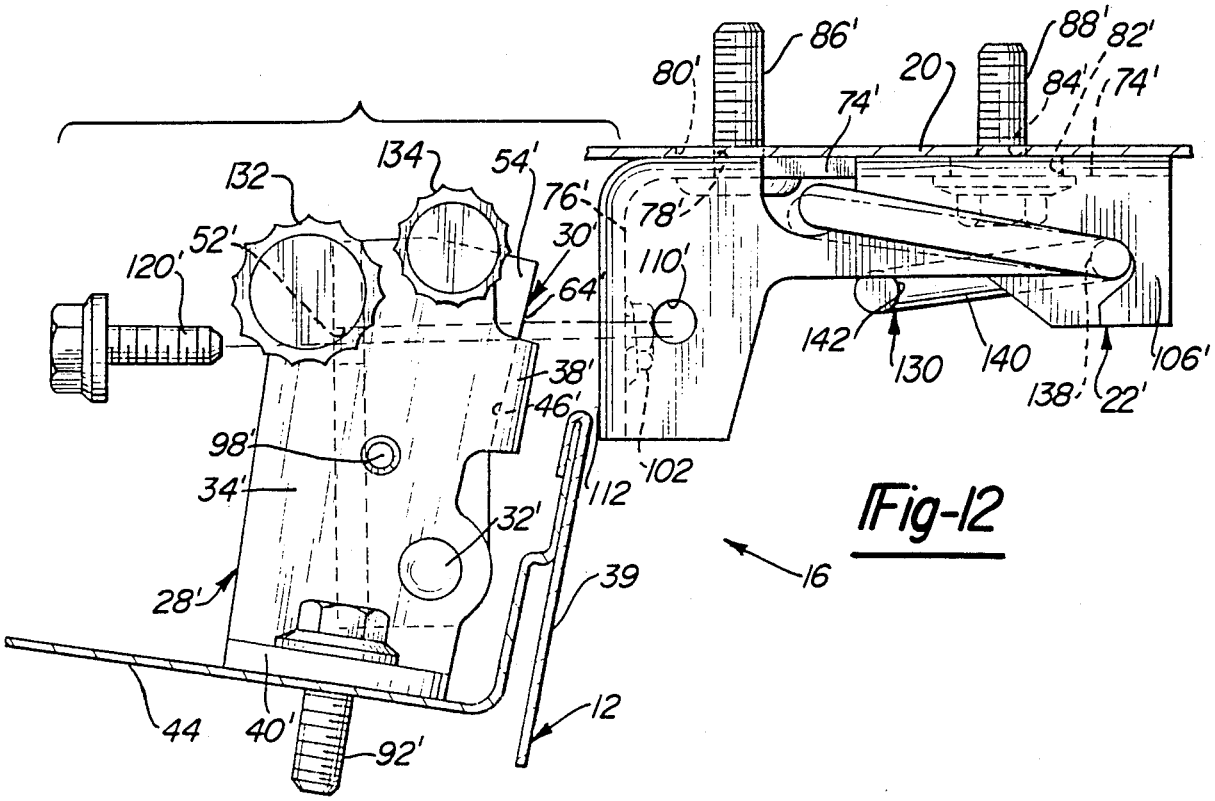
FIG. 12 is a view similar to FIG. 10 showing the door separated from the body in its lift-off mode.
Figure 13:
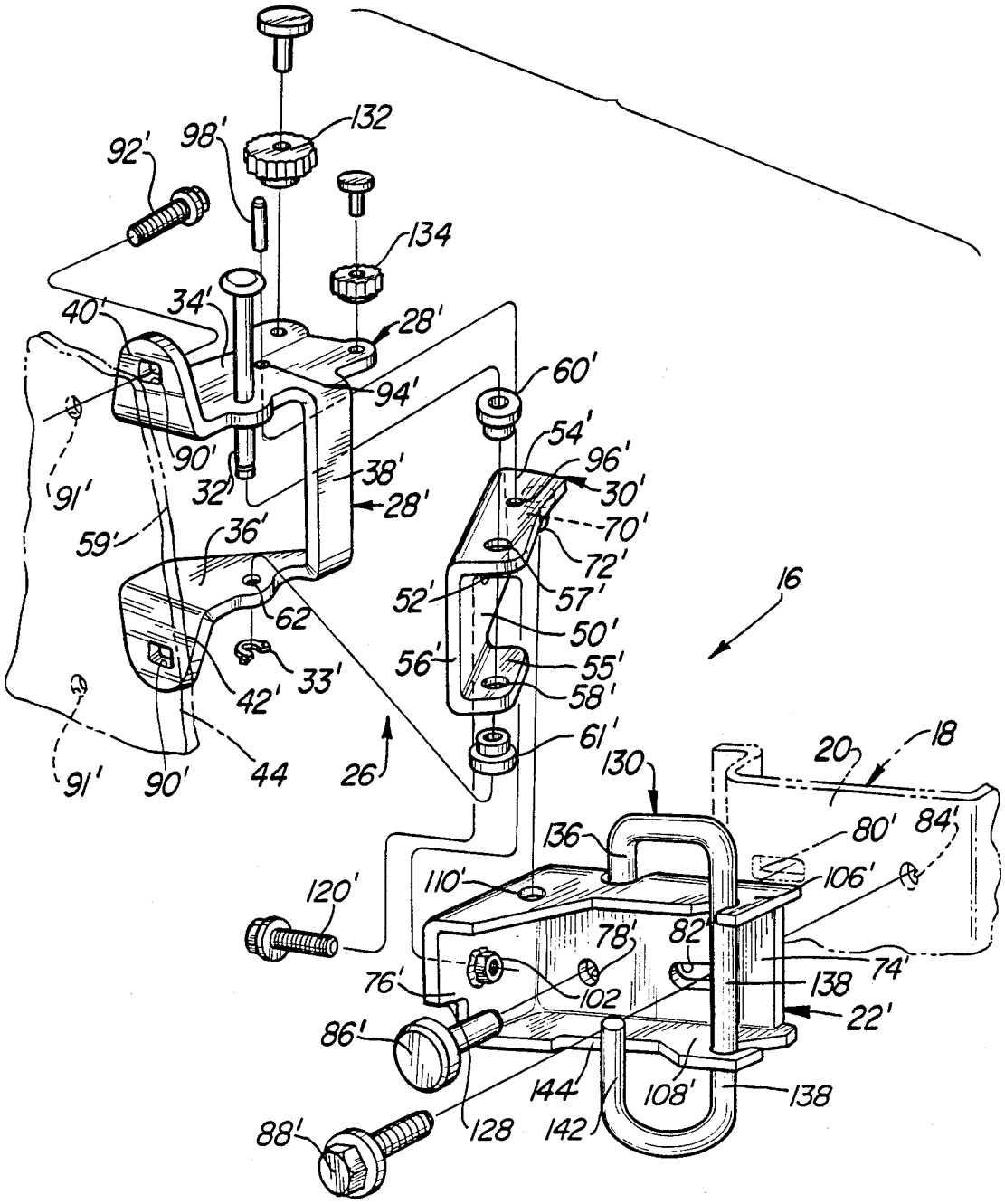
FIG. 13 is an exploded perspective view of the lower hinge assembly of FIG. 9.

With reference to FIGS. 12 and 13 the link plate 30' comprises a vertically disposed base wall 50' having a through-bore 52' located adjacent one vertical side edge 53'. The base wall 50 is formed with an upper horizontally disposed upper full flange 54' and lower partial flange 55' extending parallel to the full flange 54'. It will be noted that the partial flange 55' is located adjacent the other vertical side edge 56' of the base wall 50'. Aligned holes 57' and 58' are provided in the upper full flange 54' and the lower partial flange 55', respectively. Upon the pin 32' being inserted in the hinge door mounting plate upper arm hole 59', the pin 32' is journally received in aligned journal bearings 60' and 61', fitted in respective holes 57' and 58' of the link plate 30', prior to positioning the pin 32' in link plate lower arm hole 62' and locked by snap ring 33'.

As mentioned with respect to the upper hinge assembly 14 angled edge 64' causes the link plate upper flange 54' to be trapezoidal-shaped in plan. It will be seen in FIGS. 11 and 13 that upper full flange undersurface 68' has an elongated cylindrical dowel 70' extending vertically downwardly therefrom with its lower free end 72' rounded in a bullet-like manner. As seen in FIGS. 12 and 13 the hinge body mounting plate 22' is generally L-shaped in horizontal section providing a body mounting long leg 74' and a short leg 76' adapted for attachment with link plate 30'. The long leg 74' includes hole 78' for alignment with a body panel first mounting elongated slot 80' and an elongated or slot-shaped aperture 82' in the body plate 22' is adapted for alignment with a second body panel mounting hole 84'. As with the upper hinge assembly 14 the hole 78' has a threaded stud 86' fixed therein, as by welding, while the slotted aperture 82' and aligned panel hole 84' are adapted to receive a threaded machine bolt 88'. The door mounting plate 28' of the door-half sub-assembly 26' is fixed to the door frame panel 44 by means of the mounting ears 40' and 42' having elongated slots 90' adapted for alignment with associated door frame holes 91' so as to receive threaded bolts 92'.

Figure 10:
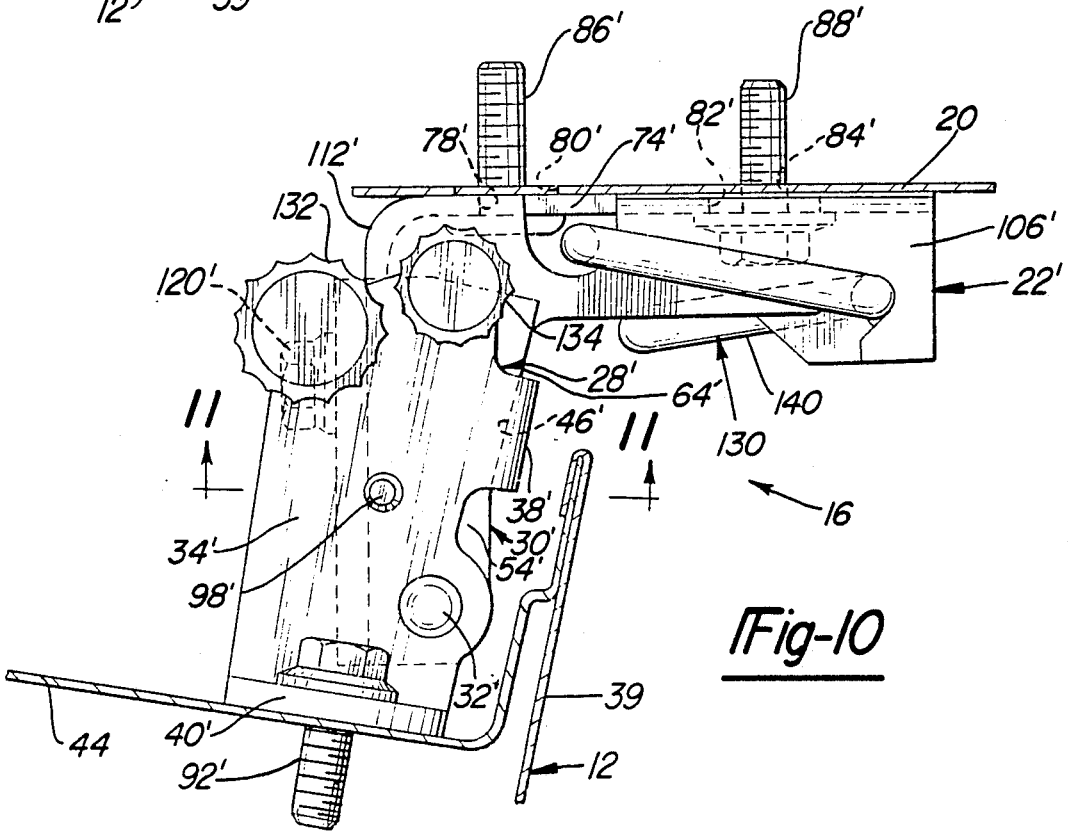
FIG. 10 is a view similar to FIG. 9 showing the door lower hinge assembly in its intermediate check or partial open locked lift-off mode.
Figure 11:
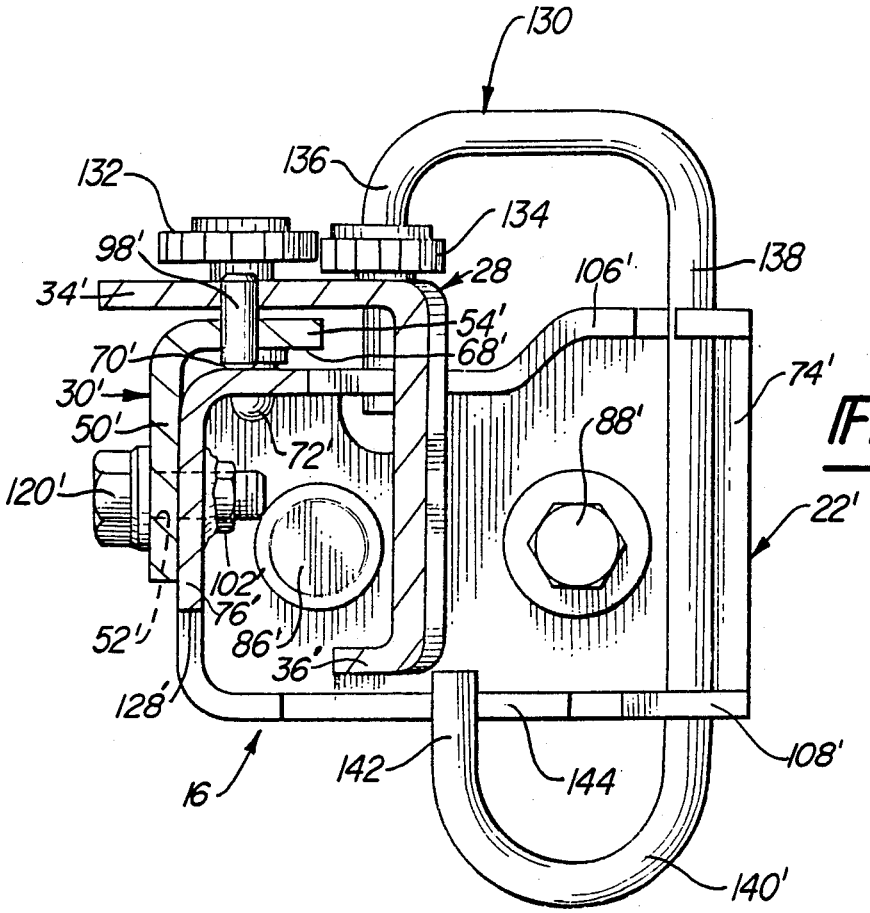
FIG. 11 is a vertical sectional view taken on the line 11—11 of FIG. 10.

With reference to FIGS. 11–13 the door mounting plate 28' has its upper arm 34' provided with a keyway 94' adapted to be aligned with a subjacent keyway 96' in the link plate upper flange 54' upon the door 12 being pivoted through a predetermined angle to its full-open shown in FIG. 10.

As best seen in FIGS. 11–13, a torsion bar 130 is mounted in preloaded condition on the body mounting plate 22' of the lower hinge assembly 16 for hold-open purposes. The hold-open torsion bar 130 arrangement is disclosed generally in U.S. Pat. Nos. 3,729,772 and 3,870,361. Two spaced scalloped detent rollers 132 and 134 are shown to which a deflectable portion 136, parallel to principal portion 138 of the torsion bar 130, is flexed in the door opening and closing movements. Upon the roller 132 deflecting portion 136, the door 12 is held open releasably in its intermediate check or partially open position. Deflection of the portion 136 by roller 134 places the door in its second full open check position. The torsion bar 130 has a lower radius arm 140 that is bent upwardly and has a free end 142 abutting a mounting portion flange 144.

As the attachment procedure for the lower hinge sub-assembly 26' to the lower body mounting plate 22' is exactly the same as for the upper hinge sub-assembly 26 to the upper body mounting plate 22 and reference may be made to the foregoing description of the upper hinge assembly 14. During automotive assembly, the vehicle door 12 is partially assembled and the upper hinge sub-assembly 26 and the lower hinge sub-assembly 26' are affixed thereto by securing the upper hinge door mounting plate 22 and the lower hinge door mounting plate 22' to the door panel 44.

Figure 14:
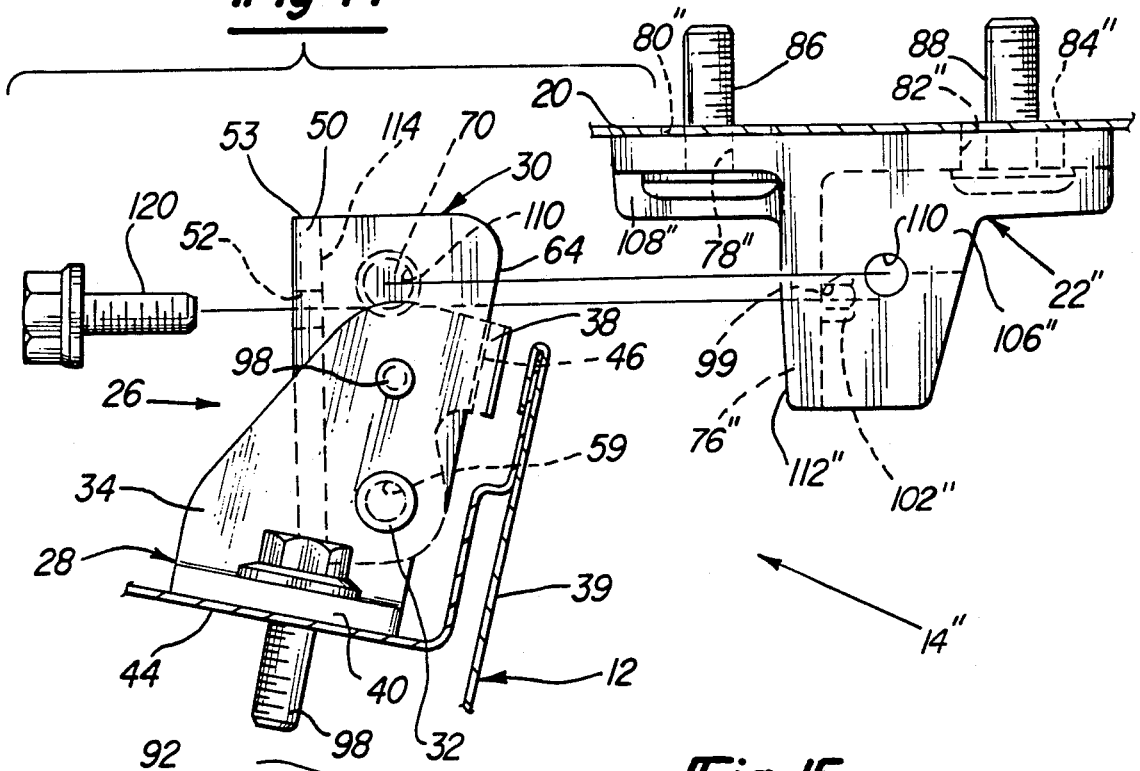
FIG. 14 is a view similar to FIG. 7 showing a modified construction of the upper hinge body mounting plate.
Figure 15:
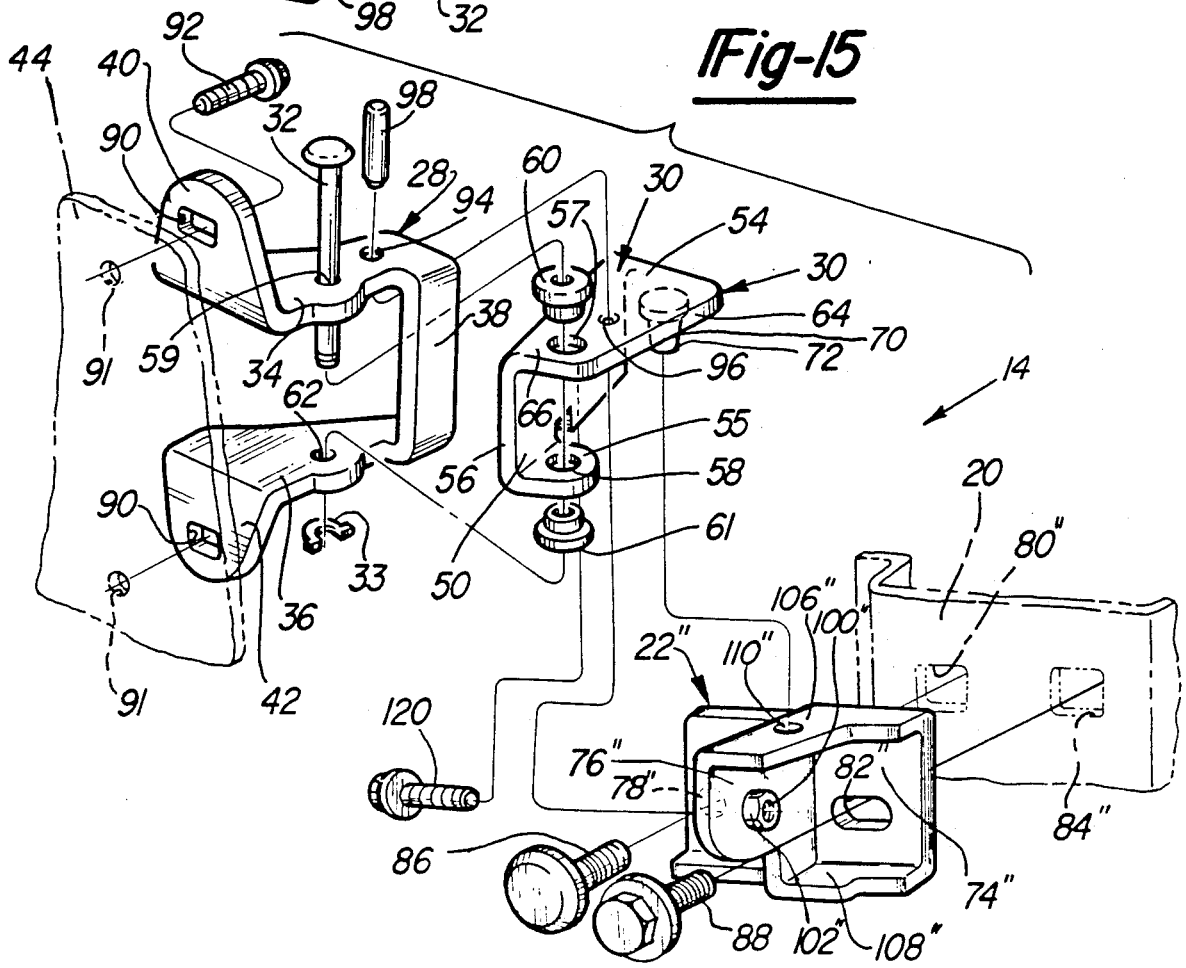
FIG. 15 is a view similar to FIG. 8 showing the hinge of FIG. 14 in exploded perspective.

FIGS. 14 and 15 disclose a modified door mounting plate 22'' adapted for attachment to a narrower body pillar. It will be noted in FIG. 14 that short leg portion 76'' is located intermediate the ends of the long leg 74''. Thus, the dowel receiving hole 110'' is located intermediate the stud 86 and the bolt 88 which is a predetermined distance further forward on the vehicle body than the dowel hole 110 shown in FIG. 7. The advantage of the FIG. 14 modification is that a larger door opening is possible with the modified body plate 22''.

While preferred embodiments of the invention have been illustrated and described, this is only for the purpose of illustration, and it is to be understood that various modifications in structure will occur to a person skilled in the art.

What is claimed is:

1. In a mounting arrangement for assembling a vehicle door to a vehicle body, a lift-off hinge assembly of the type having a door-half sub-assembly adapted to be secured to the vehicle door and a body mounting plate adapted to be secured to the vehicle body and pivotally connected by a pintle pin about a vertical hinge axis to said door-half sub-assembly, said lift-off hinge assembly particularly adapted to enable removal and mounting of the vehicle door during manufacture of the vehicle, said lift-off hinge assembly comprising:

a door-half sub-assembly including a generally hat-shaped door mounting plate adapted to be secured to the vehicle door and a generally U-shaped link plate pivotally connected to said door mounting plate by a pintle pin aligned on said hinge axis;

said door mounting plate comprising horizontally disposed upper and lower arms having their distal ends interconnected by a vertically disposed strap portion, each said arm having its proximate end formed with a right-angled mounting ear adapted to fixedly abut a panel of the vehicle door, each said upper and lower arm having a pintle pin hole therein aligned on said hinge axis;

said link plate defining a vertically disposed base wall formed with an upper flange and a lower flange lobe extending normally from an inner surface of said base wall, said base wall having a threaded bore therein located adjacent one vertical side edge thereof adapted to receive a threaded attachment bolt, said link plate flange lobe located adjacent the other vertical side edge of said base wall, said upper flange and said lower flange lobe each having a hole therein aligned on said hinge axis for reception of said pintle pin therethrough, said link plate upper flange undersurface having a mounting dowel fixed thereon adjacent said other vertical edge and extending vertically downwardly therefrom;

said link member upper flange and said door mounting plate upper arm having aligned keyways adapted to receive a key therethrough locking said link plate and said door mounting plate together upon said door mounting plate being pivoted about said pintle pin axis to a predetermined partially open door lift-off position relative to said link plate;

said body mounting plate being L-shaped in horizontal section comprising a body mounting first leg secured in flush contact to a panel of said body and a link plate attaching second leg extending at a right angle from said body mounting first leg, said second leg formed with a threaded through bore;

said body mounting plate formed with an upper horizontally disposed web having a coupling dowel hole adapted to receive said link plate dowel therein without play;

said link plate member being of a size such that upon its initial lateral movement relative to said body mounting plate its base wall interior surface being placed in flush contact with the exterior surface of said body mounting plate second leg, such that said link plate upper flange is spaced a predetermined distance above said body mounting plate web with said dowel axis aligned on the center of said dowel hole;

whereby upon said door being lowered a predetermined vertical distance said link plate attachment dowel being received in said body plate upper web dowel hole such that said link plate base wall threaded bore is aligned with said body mounting plate second leg threaded bore whereby said attachment bolt engages said threaded bores such that upon tightening said bolt said body mounting plate and said link plate are drawn together in predetermined interlocked engagement for conjoint swinging movement about said hinge axis relative to said door mounting plate after removal of said locking key from its associated keyways.

2. The mounting arrangement as set forth in claim 1 wherein said door mounting plate strap portion having its inner surface adapted to contact an opposed edge of said link plate upper flange upon said door being pivoted to a predetermined open position providing stop means wherein said door mounting plate upper arm keyway is aligned with said link plate upper flange keyway allowing said locking key to be inserted in said aligned keyways thereby locking said body mounting and link plates in a predetermined lift-off mode whereby said threaded bolt may be removed.

3. The mounting arrangement as set forth in claim 1 wherein upper and lower hinge assemblies are secured to said vehicle door in vertically spaced relation such that upon pivoting said door to a predetermined open position said upper and lower hinge assemblies have associated keyways aligned by stop means such that upon the insertion of a locking key in each said pair of aligned keyways whereby the removal of an associated threaded attachment bolt from each said upper and lower hinge assembly permitting lift-off removal of each said upper and lower door-half sub-assembly from its associated body mounting plate.

4. The mounting arrangement as set forth in claim 3 wherein said lower hinge assembly incorporating a torsion bar arrangement on the lower hinge assembly body mounting plate and detent rollers on said lower hinge assembly door mounting plate cooperating to provide a predetermined hold-open position of said door.

* * * * *